United States Patent [19]

Garner

[11] Patent Number: 4,577,403

[45] Date of Patent: Mar. 25, 1986

[54] MANUFACTURE OF TELECOMMUNICATIONS CABLE CORE UNITS

[75] Inventor: John N. Garner, Kingston, Canada

[73] Assignee: Northern Telecom Limited, Montreal, Canada

[21] Appl. No.: 738,714

[22] Filed: May 29, 1985

[51] Int. Cl.[4] ..... H01R 43/00; B21D 39/04; D07B 1/06; B65H 57/14

[52] U.S. Cl. ..... 29/872; 29/755; 29/33 F; 57/7; 57/314; 57/352; 156/50; 156/166; 156/441

[58] Field of Search ..... 57/314, 7, 352, 358, 57/359, 360, 138; 156/50, 51, 54, 55, 166, 200, 201, 202, 433, 441; 29/33 F, 868, 755, 419, 872; 72/179; 140/2; 264/272.11, 272.15

[56] References Cited

U.S. PATENT DOCUMENTS

| | | | |
|---|---|---|---|
| 1,909,513 | 5/1933 | Agar | 156/200 |
| 2,530,726 | 11/1950 | Rasmussen | 57/314 X |
| 3,001,353 | 9/1961 | Lapsley | 57/314 X |
| 3,056,942 | 10/1962 | Carbaugh et al. | 29/868 X |
| 3,193,904 | 7/1965 | Evans et al. | 57/31 X |
| 3,345,917 | 10/1967 | Agett et al. | 156/201 X |
| 3,695,027 | 10/1972 | Copp | 57/7 |
| 4,044,447 | 8/1977 | Hamada et al. | 29/419 |
| 4,443,277 | 4/1984 | Kokas | 156/201 X |

FOREIGN PATENT DOCUMENTS

| | | | |
|---|---|---|---|
| 66894 | 10/1943 | Norway | 57/31 |

*Primary Examiner*—John M. Jillions
*Assistant Examiner*—Joseph J. Hail, III
*Attorney, Agent, or Firm*—R. J. Austin

[57] ABSTRACT

Forming a core unit from telecommunications conductor units of twisted together conductors in which the units are first changed in relative positions laterally of their passline and then are passed between two rollers to form them into a curved array. The positions of the units in the array influence their final positions in the core unit as they move towards a core unit closure device. Hence as the positions in the array change because of the positional change in relative positions of the units upstream from the array, then the units change in relative positions in the core unit by extending backwards and forwards around the core unit axis.

8 Claims, 19 Drawing Figures

MANUFACTURE OF TELECOMMUNICATIONS CABLE CORE UNITS

This invention relates to the manufacture of telecommunications cable core units.

A telecommunications cable is constructed with a core comprising one or more core units, each having a multiplicity of twisted units of conductors, each unit conventionally being a twisted pair of conductors. A core may be formed as a single core unit of twisted pairs, e.g. fifty or one hundred pairs, or larger cores, i.e. up to thirty-six hundred twisted pairs, each comprise a plurality of core units. The twisted pairs are stranded together to form a core unit with the conductors of each pair twisted together with a predetermined lead to the twist, i.e. the distance taken along the pair for each conductor to complete a single revolution along its path. This distance is normally referred to as the "twist lay" of the pair. There are different twist lays provided for the twisted pairs in a core unit with a pair having a particular twist lay being adjacent to other pairs of different twist lays. Care is taken, so far as is practicable, to ensure that pairs of equal or similar twist lays are separated from each other. The reason for this arrangement is an attempt to maximize the communications performance of the cable, e.g. to lessen pair-to-pair capacitance unbalance, to reduce cross-talk between the pairs and to lower the coefficient of deviation of mutual capacitance of pairs in the cable. To reduce the pair-to-pair capacitance unbalance and to improve cross-talk, suggestions have been made to move the conductor pairs relative to one another as they progress towards a stranding machine for stranding them into a core unit so that in the finished core unit, the conductor pairs change in relative positions and distances apart. In a suggested method for changing the relative position of conductor pairs as they move towards the stranding machine, the conductor pairs enter a guide arrangement which comprises a system of horizontal guides movable horizontally and located in vertically tiered fashion. This method was first suggested by S. Norblad of Telefonaktiebolaget L.M. Ericsson, in a paper entitled "Capacitance Unbalance Telecommunications Networks" read before the International Wire and Cable Symposium in 1971.

Further methods of changing the relative positions of the conductor pairs have also been suggested. These include the method and accompanying apparatus which is described and claimed in U.S. patent application Ser. No. 637,594, filed Aug. 3, 1984 (Canadian Application No. 459,921 filed July 27, 1984), and entitled "Manufacture of Telecommunications Cable Core Units" in the name of J. N. Garner. In that patent application, apparatus is described for forming a core unit in which a plurality of position changing means are provided for conductor units, each position changing means operating to change the position of a conductor unit across the feedpath relative to other units. In this apparatus, each position changing means comprises a guide and means to reciprocally move the guide across the feedpath. The position changing means are disposed in series with one another along the feedpath with their reciprocating means overlapping one another in a view taken along the feedpath and the arrangement of position changing means is such that each guide is aligned for unobstructed passage of a conductor unit as it moves along the feedpath.

Thus although suggestions have been made to move the conductor pairs relative to one another in the finished core unit, it still remains necessary to use a stranding machine to provide a core unit in which the twisted conductor units move around the axis of the core unit as they extend along its length. This type of assembly of core unit is preferred, because it provides a more positive assembly of the conductor units in a core unit and also enables the finished cable to be flexed either during spooling or laying into operating position by virtue of the fact that the conductor units extend angularly around the core unit.

While stranding machines are obviously very efficient in producing the required core unit structure, they are of complex construction. A core unit take-up reel is required which needs to be rotated not only around its own axis, but also around the axis of the machine so as to simultaneously provide the stranding action of the stranding machine and also take-up the core unit after its formation. The take-up reel, especially when partially or almost completely loaded with core unit, has substantial weight and thus provides a substantial moment of inertia as it is rotated around the axis of the stranding machine to provide the stranding action. To provide for such a rotational movement, stranding machines are very heavily built and are expensive to manufacture. In addition to this, because of the location of the take-up reel and the need for it to rotate about two axes, it is an extremely tedious and time consuming operation for a completely loaded take-up reel to be removed and for a succeeding and empty reel to be located within the stranding machine.

It is an object of the present invention to provide a method and apparatus for forming a core unit which avoids the use of a stranding machine while causing conductor units to extend around the core unit at an angle to its length. It is also an object of the invention to provide a method and apparatus which, while avoiding the use of a stranding machine, enables the core unit so formed to be assembled directly onto a take-up reel which is rotating in one direction only or alternatively, enables the completed core unit to be moved directly in line or in tandem with apparatus which provides the core unit with either a surrounding sheath or shield or a jacket material or both.

Accordingly, the present invention provides apparatus for forming a core unit from telecommunications conductor units each formed of twisted together insulated conductors comprising, in a downstream direction along a passline for the conductor units, a position changing means for changing the positions of laterally spaced-apart conductor units across the passline and relative to other conductor unit, conductor unit array forming means comprising at least two rollers having rotational axes one downstream from the other with opposed peripheral surfaces of the rollers spaced-apart one on each side of the passline, each surface changing in diameter along its length with one surface having its smallest diameter and the other its largest diameter at a position intermediate its axial ends, the positions and configurations of the surfaces being such that together they are operable to position the conductor units in an array as the conductor units move towards, past and then beyond the rollers, the array extending in two planes in a section taken across the passline, the rollers enabling the conductor units to move across the array dependent upon the positional charge caused by the position changing means; and core unit forming means for causing convergence of the conductor units in the array to bring them together with the relative positions of the conductor units changing in the core unit as they extend along the core unit, each conductor unit extending around the core unit axis alternately in opposite directions as influenced by its movement across the array.

In a preferred construction, the position changing means is operable for continuous operation to move the conductor units across the passline in a continuous fashion. In a further preferred arrangement, one of the rollers has a concave peripheral surface and the other a convex peripheral surface.

The invention also provides a method for forming a core unit from telecommunications conductor units each formed of twisted together insulated conductors, the method comprises (a) moving a plurality of conductor units in laterally spaced relationship along a passline while:- moving the laterally spaced conductor units into an array across the passline, the array of controlled configuration extending in two planes in a section across the passline, and moving each conductor unit alternately in opposite directions across the passline independently of other units at a position upstream from the array so that each conductor unit moves alternately in opposite directions across the array and the conductor units move laterally relative to one another in the array; and (b) causing the conductor units in the array to converge as they continue along the passline so as to bring them together to form the core unit with the relative positions of the conductor units changing in the core unit as influenced by their relative positions in the array and with each conductor unit moving around the core unit axis alternately in opposite directions as it moves along the core unit and as influenced by its movement across the array.

By the use of the apparatus and the method according to the invention, conductor units are caused to move around the axis of the core unit as they extend along its length. While the conductor units will not continuously move around the core unit axis in a single direction, as in conventional constructions, nevertheless the advantages obtained by conventional core unit construction will be obtained with a core unit made in the inventive manner. Movement of the conductor units in opposite directions around the axis of the core unit formed by the inventive method and apparatus provide the angular orientation relative to the axial direction so as to enable the core unit and the finished cable to be flexed in the acceptable fashion. In the core unit made by the method according to the invention, if sufficient lateral movement is provided for each of the conductor units in the array, then each conductor unit as it extends axially may also move around the core unit axis for almost a complete revolution in each direction.

One embodiment of the invention will now be described, by way of example, with reference to the accompanying drawings, in which.

Figure 1:
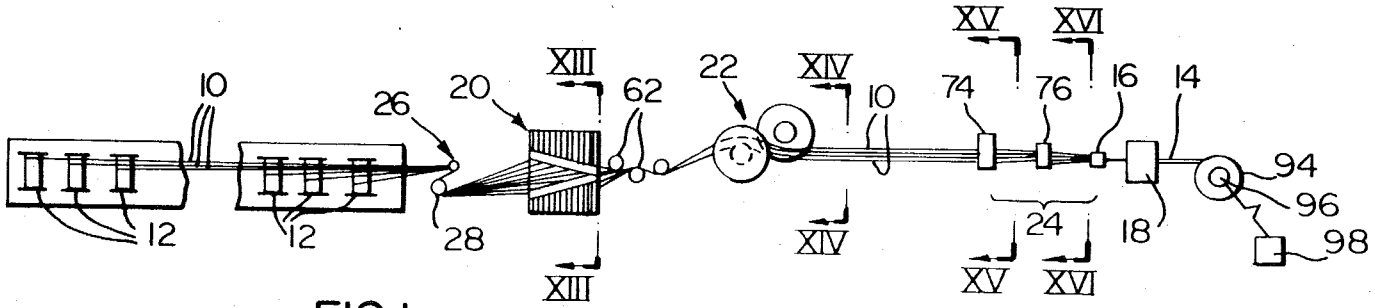
FIG. 1 is a side elevational view of apparatus for forming a core unit from conductor pairs.
Figure 2:
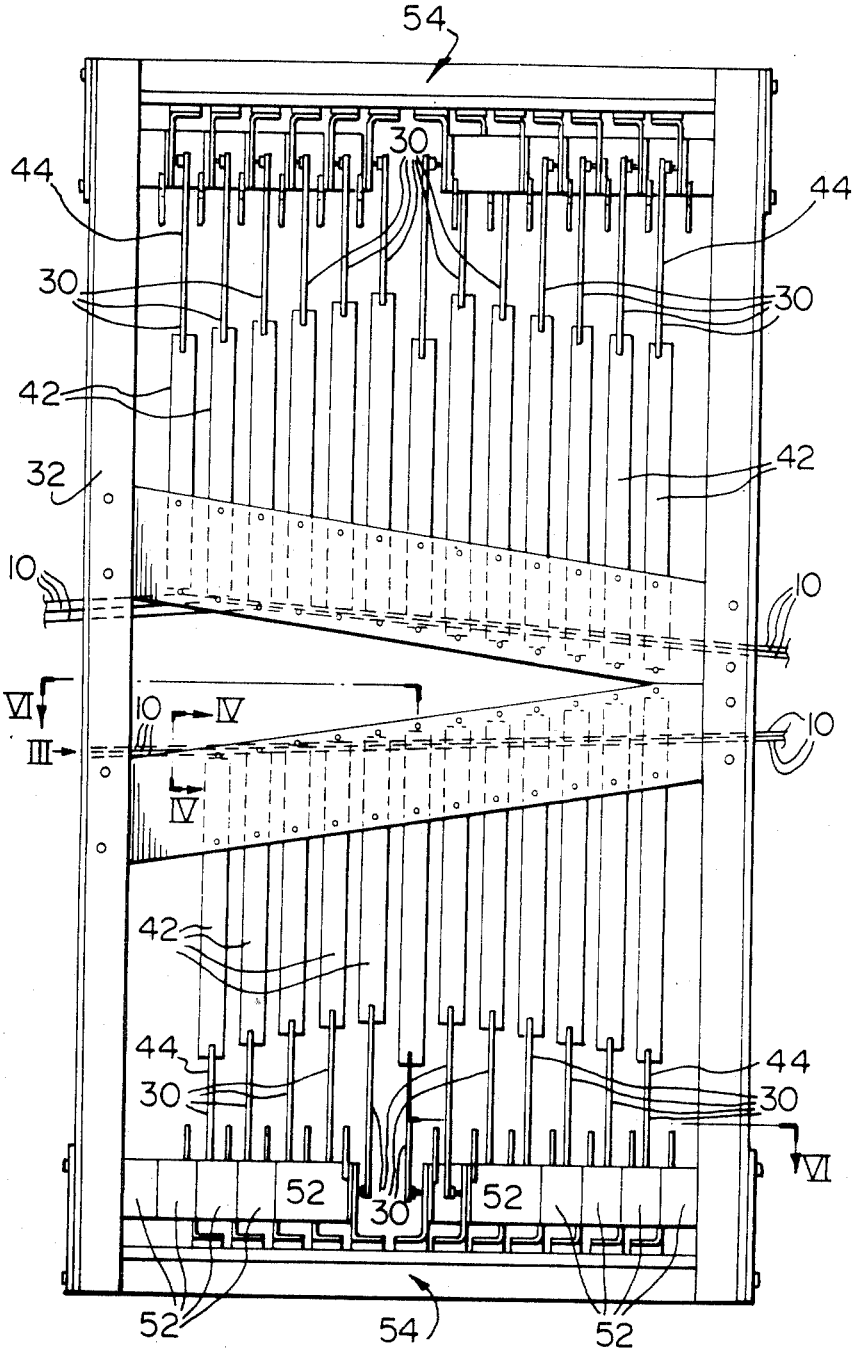
FIG. 2 is a side elevation of a position changing means for conductor pairs and on a larger scale than shown in FIG. 1.
Figure 6:
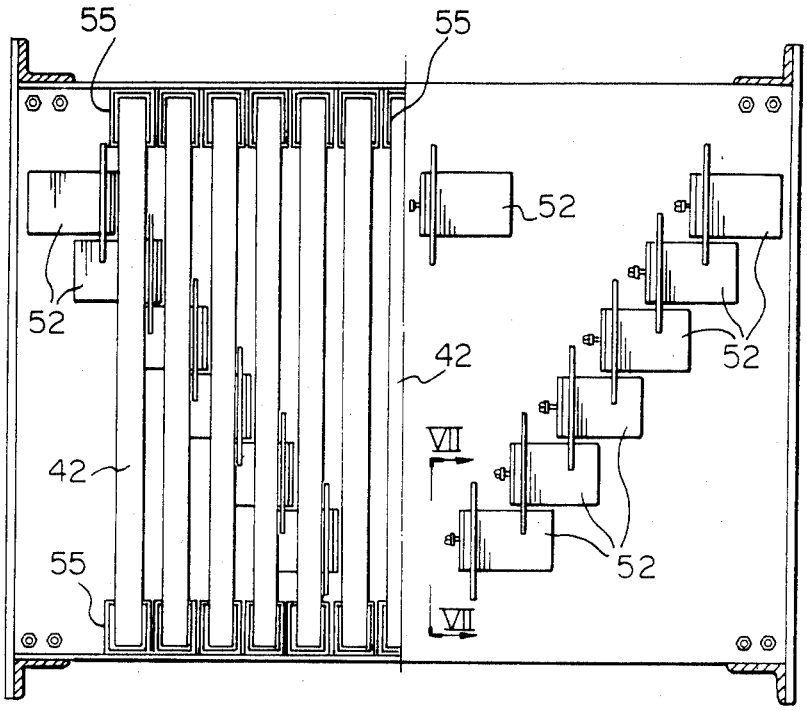
Figure 7:
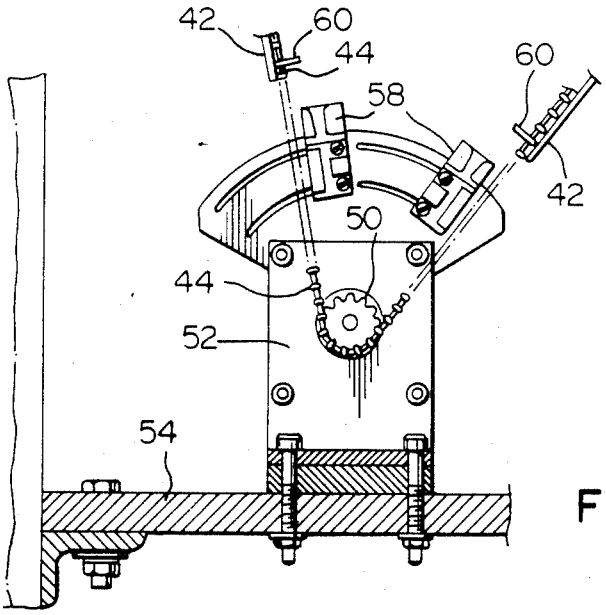
Figure 10:
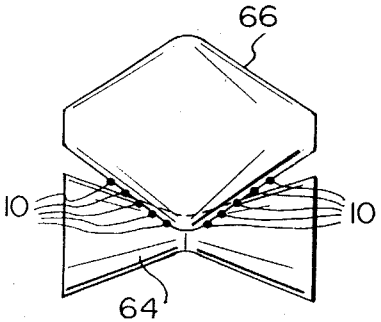
Figure 8:
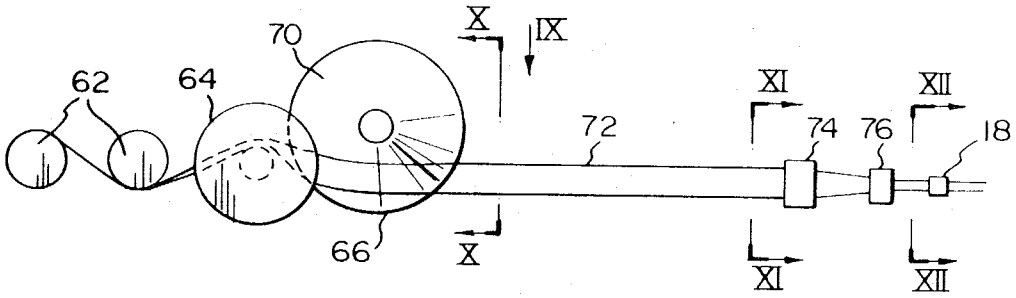
Figure 9:
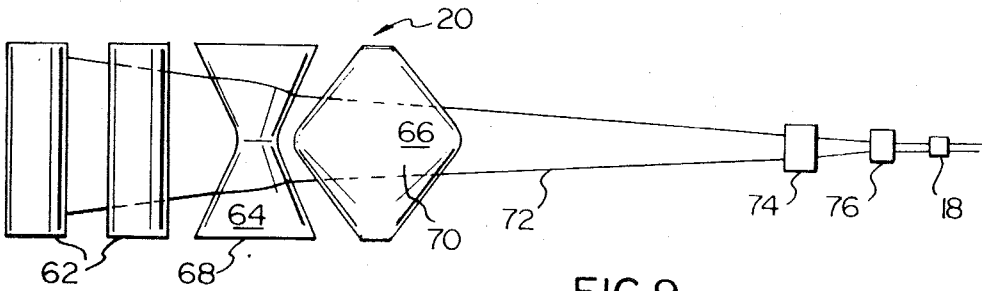
Figure 11:
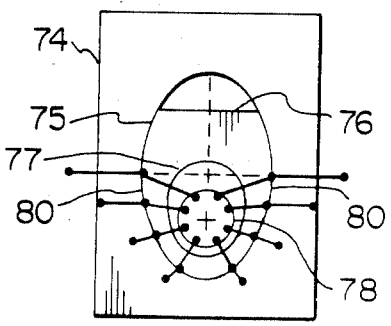
Figure 12:
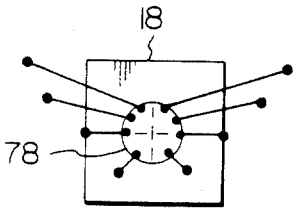
Figure 13:
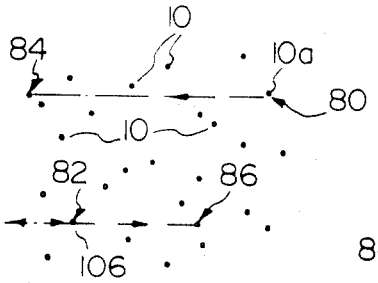
Figure 14:
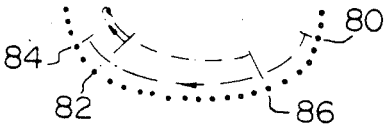
Figure 15:
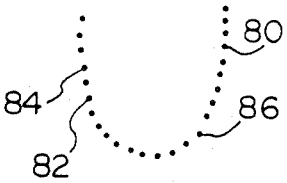
Figure 16:
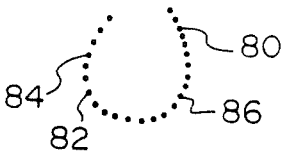
Figure 17:
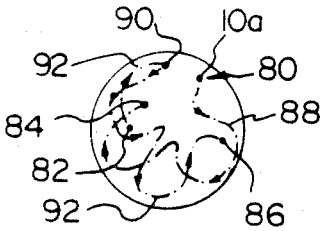
Figure 19:
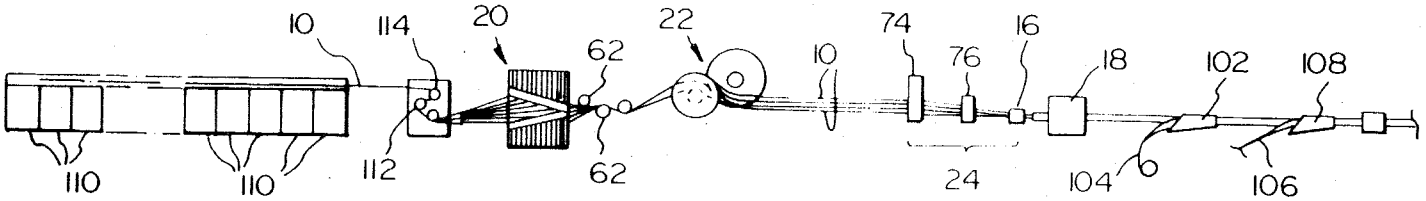
Figure 18:
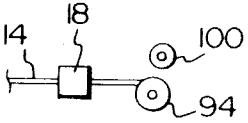

FIG. 6 1s a cross-sectional view taken along line VI—VI in FIG. 2;

FIG. 7 is a cross-sectional view taken along line VII—VII in FIG. 6 and on a larger scale;

FIG. 8 is a side elevational view of a conductor unit array forming means and core unit means and shown on a larger scale than in FIG. 1;

FIG. 9 is a view of a part of the apparatus in FIG. 8 and in the direction of arrow IX in FIG. 8;

FIG. 10 is a view of the apparatus taken in cross-section of the conductor units along the line X—X in FIG. 8;

FIGS. 11 and 12 are cross-sectional views respectively taken along lines XI—XI and XII—XII in FIG. 8;

FIG. 13 is a cross-sectional view through the conductor units taken along the line XIII—XIII in FIG. 1 to show in diagrammatic fashion, the relative positions of conductor units from time-to-time as they issue from the position changing means;

FIGS. 14, 15 and 16 are views similar to FIG. 13 taken along lines XIV—XIV, XV—XV and XVI—XVI in FIG. 8 to show the relative positions in the conductor units after passage through the array forming means and also during convergence of the conductor units during core unit formation;

FIG. 17 is a diagrammatic cross-sectional view through a finished core unit and showing the positional change of various conductor units within the core unit;

FIG. 18 is a view similar to FIG. 1 of one end of a modification of the embodiment; and FIG. 19 is a view similar to FIG. 1 of a second embodiment.

The apparatus according to the invention is particularly useful for a tandem or "in-line" operation for twisting individually insulated conductors together into conductor pairs and then for forming these conductor pairs into a core unit.

As shown in the embodiment, twenty-five conductor pairs 10 (FIG. 1) each formed from two twisted together individually insulated conductors, are drawn from twenty-five reels 12 of the conductor pairs in conventional fashion. A core unit 14 is formed at the downstream end of the apparatus by passing the conductor pairs through a closing die 16 which draws the conductor pairs together and a binding head 18 at which position a binding material is closed around the drawn together conductor pairs to hold them together in conventional manner. The closing die forms part of a core unit forming means 24 for causing divergence of the conductor units into a core unit.

Disposed between the reels 12 and the means 24 are a position changing means 20 and a conductor unit array forming means 22. The position changing means and the conductor unit array forming means ensure that the conductor pairs are moved relative to each other and in such a fashion that the finished core unit has conductor pairs extending around its axis alternately in each direction as the conductor units extend along the length of the core unit.

The position changing means 20 and a guide means 26 which precedes it are of the construction described in a copending U.S. patent application Ser. No. 637,594 filed Aug. 3, 1984 (Canadian Application No. 459,921 filed Jul. 27, 1984) entitled "Manufacture Of Telecommunications Cable Core Units" in the name of J. N. Garner.

The guide means 26 comprises a roller 28 which is freely rotatably mounted upon a machine frame (not shown) and the roller is provided with a plurality of annular grooves (not shown) as described in the aforementioned application. As can be seen from FIG. 1, the conductor pairs are fed from the reels 12 and through the guide means. Each conductor pair is disposed in its own individual groove in the roller 28 so as to maintain the conductor pairs separate from one another as they approach the position changing means 20.

Figure 4:
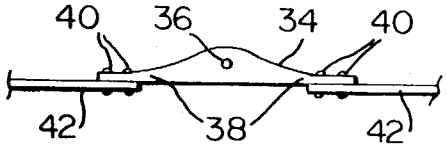
FIG. 4 is a cross-sectional view of the position changing means taken along line IV—IV in FIG. 2 and on a larger scale.
Figure 5:
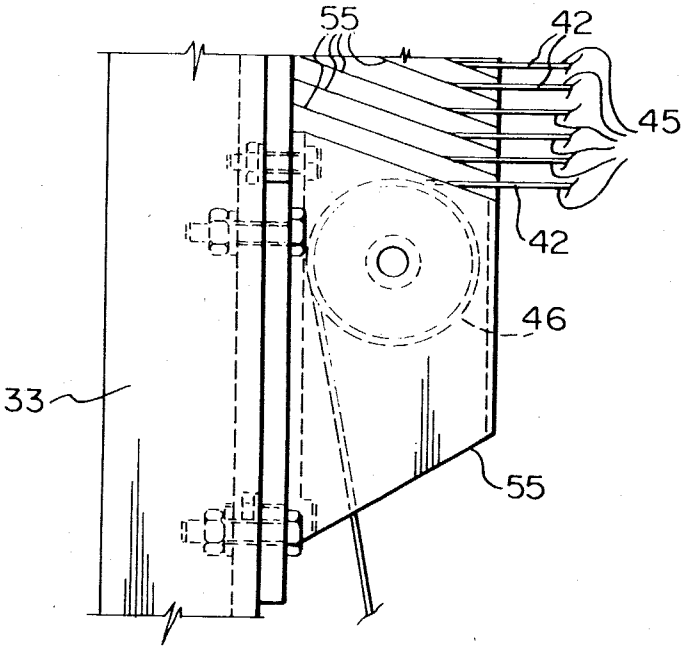
FIG. 5 is a end view of a detail in the same direction as FIG. 3 and on a larger scale.
Figure 3:
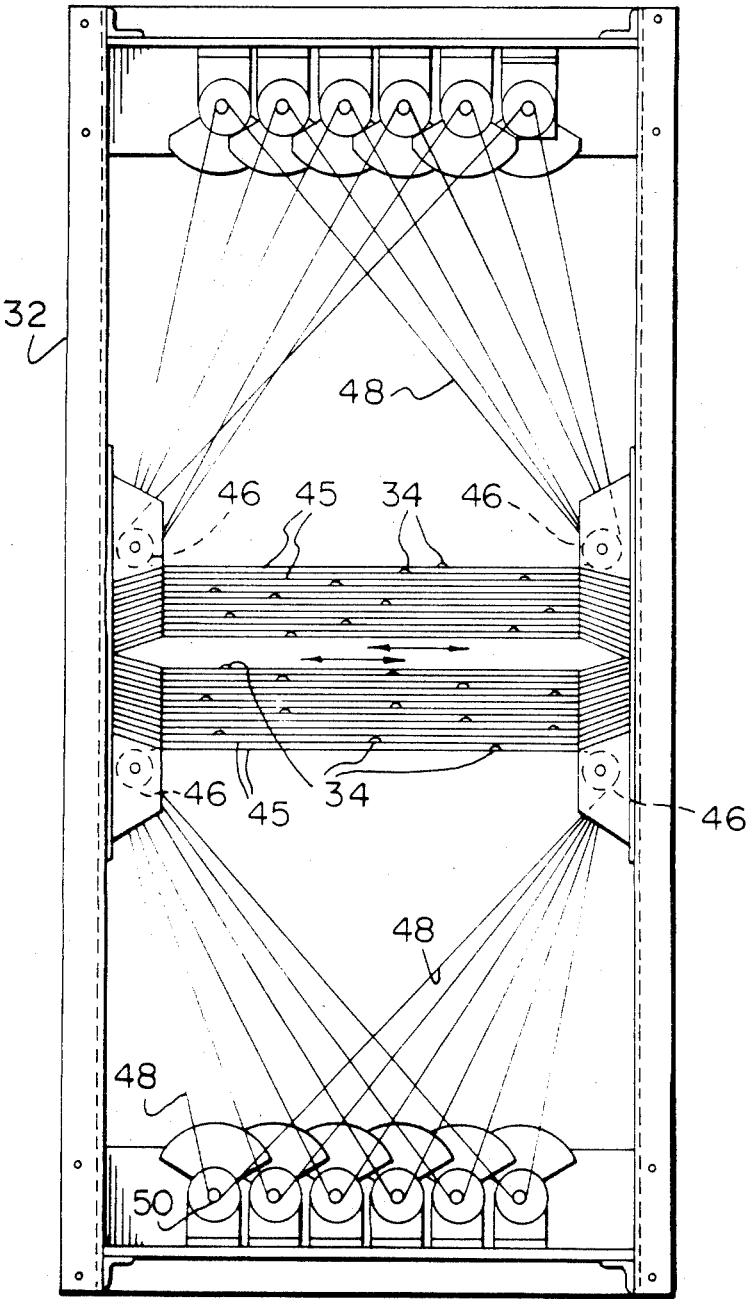
FIG. 3 is a view of the position changing means in the direction of arrow III in FIG. 2.

As shown by FIGS. 2 and 3, a plurality of position changing means 30 are provided for the conductor pairs, one position changing means for each pair. The position changing means are all housed within a straight sided frame 32. The position changing means are disposed in two groups, one vertically above the other, with the position changing means in each group lying in series with one another along the feedpath for the conductor pairs. Each position changing means comprises a guide 34 for a conductor pair. This guide, as shown by FIG. 4 has a guide passage 36 that is formed with two side wings 38 attached with rivets 40 to an endless moving means for the guide, the moving means comprising a flat plastics belt 42 through which the rivets 40 pass. The endless moving means also comprises a chain 44 which extends between the ends of the belts as shown in FIG. 7. Each endless moving means has a horizontal flight 45 formed by the belt 42 and the associated guide 34, the belt mounted around two pulleys 46 at the sides of the machine frame to proceed as two flights 48 towards a sprocket 50 around which the chain 44 passes. The endless moving means overlap one another, as shown particularly in FIG. 3, and the arrangement is such that each guide is aligned for unobstructed passage for its conductor pair as the pair moves along the feedpath. This clear passage for movement is achieved by disposing the horizontal flights 45 of the belts 42 of each group of position changing means at different vertical levels as shown by FIG. 3. In practice, with the lower group, the horizontal flights are displaced progressively vertically upwards from one changing position to the next in the downstream direction of the feedpath by locating the pulleys upwardly from each position changing means to the next on supports 55 (see FIG. 5). In contrast the horizontal flights of the upper group are displaced vertically downwards in a downstream direction of the feedpath. The horizontal flights of the two groups oppose each other across the feedpaths and approach each other progressively in a downstream direction. The advantages for this arrangement are as discussed in the aforementioned application.

Each of the endless moving means is movable independently of the others. For this reason, each position changing means is provided with its own reversible stepper motor 52 (see FIGS. 2, 3 and 7). All of the stepper motors 52 are mounted remotely from the horizontal flights by being attached to upper and lower panels 54 of the machine stand. Each motor is directly drivably connected to a sprocket 50 which engages with its respective chain 44 as shown by FIG. 7. The drive motors may be driven at the same speed as each other whereby the guides 34 move along their horizontal flights at the same speed but out of phase with each other. However, in this embodiment the drive motors are driven at speeds which are slightly different from each other so that the positional relationship of all of the guides is continuously changing while reducing the possibility of a set pattern of movement of the guides 34.

A reversing means is provided for each drive motor 52 to cause its belt 42 to reciprocate. As shown by FIG. 7, and more clearly described in the aforementioned application, the reversing means for each direction of movement of a belt 42 comprises a magnet carried in one leg of a head 58 which is U-shaped in side elevation (not shown). The other leg carries a magnetic field receiving means in the form of a coil (not shown) affected by inductance of the magnetic field created by the magnet. Each coil sends signals into an electrical circuit (not shown), the strength of the signals dependent upon the strength of the magnetic field induced in the coil and produced by the magnet. A trigger device in the form of an arm 60 is secured to and projects sideways from the chain 44 so as to be aligned with the gap in the head 58. The position of the arm on the chain is dictated by the position required to influence the magnetic field, i.e. by a location within the gap when the guide 34 is at the end of its movement on the horizontal flight of its belt in the appropriate direction.

In use of the position changing means, the conductor pairs 10 are fed to their individual changing means 20 in the manner described with reference to FIG. 1. Each conductor pair is passed through a respective guide 34 and proceeds from there around two in series arrangement rollers 62 prior to passing to the conductor unit array forming means. As the conductor pairs move along their feedpaths in spaced positions through the position changing means, the independent motors 52 rotate at their own speed, possibly controlled by a computer, so as to move the belts 42 to reciprocate the guides horizontally. During this movement, each of the conductor pairs passes both over and under horizontal flights of the belts 42 of position changing means in its own group, as shown by FIG. 2. In this figure, the paths of only six conductor pairs 10 are shown for clarity. Movement of the guides 34 independently of other guides continuously changes the relative positions of all of the conductor pairs as they pass through the position changing means. Thus as conductor pairs pass around the arrangement roller 62, their positions in the plane of contact with the rollers are dependent upon the positions of the pairs at any particular time moving through the guides 34. The relative lateral movement of conductor pairs will be discussed below.

While the position changing means is useful for producing positional change of conductor units in the finished core unit, any progression of conductor units around the axis of the core unit as they extend along its length is a random occurrence and takes place in a localized region. In the aforementioned application Ser. No. 637,594, the progression around the core unit was provided by a stranding machine in conventional fashion. In the apparatus of the present invention however, the stranding machine is replaced by the conductor unit array forming means 22 which simplifies the structure of the apparatus and also simplifies the reeling of cable core and removal of filled reels and their replacement.

To be able to provide for any movement of each conductor unit around the core unit axis in progressive fashion, then the conductor unit array forming means must produce movement of each conductor pair not only in one plane as with the position changing means, but also in a second plane in a cross-section taken along the passline. To achieve this two planar movement of each conductor pair, the forming means 20 operates to convert the planar arrangement of the conductor pairs as they issue from the rollers 62 into a two planar array 72 in a section taken across the feedpath. Thus any lateral movement of any conductor pair as produced by the position changing means, will be translated into a movement across the array in two directions.

As can be seen from FIG. 1 and more clearly from FIGS. 8 and 9, the array forming means comprises two rollers 64 and 66. The roller 64 is disposed with its axis of rotation slightly upstream from that of roller 66 with the rollers disposed one on each side of the passline. The outer peripheral surfaces of the two rollers vary in diameter along their axial lengths as shown by FIG. 9. In the case of roller 64, its outer peripheral surface 68 is of concave curvature whereas the surface 70 of roller 66 is convex. As is clearly seen from the figures, especially FIGS. 9 and 10, the rollers are disposed so that their surfaces while opposing one another do not in fact form a nip between them for the conductor pairs to be moved along the passline. In contrast, the rollers coact so that the surface of each roll urges the conductor pairs against the surface of the other roll as it passes between them so as to form a curved array 72 of the conductor pairs as they issue downstream from the roller 66. This curved array is in contrast to the flat array which exits from the rollers 62 and, as can be seen from FIG. 14 particularly, has two ends which turn upwardly. The spacing apart of the rollers 64 and 66 in the manner shown, ensures that movement of the conductor pairs can take place laterally of the array as they move into and between the rollers so that the conductor pairs may be moved relative to each other. In addition to this, with the rollers curved in opposite directions as described, the coaction of the rollers urges the conductor pairs into a specific position against each roller, that position being dependent upon the position and direction of movement of each conductor pair as it moves into contact with the roller 64. In contrast, if the rollers had a relationship tending more towards a nip for passage of the conductor pairs, then movement of the pairs transversely of the array could not take place and also there might be a tendency for the conductor pairs to bunch together in between the rollers so as to follow a path of least resistance as they move towards the closing dies.

The array 72 issuing from between the rollers 64 and 66 then continues towards the core unit forming means 24 for the conductor pairs. As shown particularly by FIG. 11, the means 24 comprises an upstream profile die 74 with orifice 75 and a further profile die or dies 76 with orifice 77, these dies 74 and 76 which are for the purpose of guiding the conductor pairs in the array 72 into a more closed position in which they are aligned with the closing die 16 which causes final convergence of the conductor pairs to form the core unit 14. As may be seen from FIG. 11, the two profile die orifices 75 and 77 are somewhat elongated vertically so as to form more of an elliptical or oval shape as distinct from a circular orifice shape. In order to bring the conductor pairs into alignment with the closing die orifice 78 so as to fill it without distorting some pairs more than others in the closing die orifice, it is essential that the profile die orifices 75 and 77 have their centers disposed upwardly from the closing die orifice 78. As a result of this, as the array of conductor pairs moves into the orifice of die 74, the upturned side portions of the array engage the sides 80 of the orifice with the center of the array engaging towards the bottom regions of the orifice. The conductor pairs at the upwardly turned side edges are then directed more towards the upper regions of the profile die orifice 77 as these regions are lower than those of the die orifice 75. Hence the conductor pairs move more towards the upper regions of the dies as they progress from one die to another until upon reaching the closing die orifice 78, the conductor pairs engage around the whole of the peripheral surface of the circular die orifice in natural alignment with the orifice as they pass into it. The bunching together of conductor pairs at this stage, of course, ensures that the die 78 is filled by the pairs.

As will now be described, the relative movement of the conductor pairs in the position changing means and the formation of the array in the array forming means causes the conductor pairs to follow a path around the axis of the core unit as the core unit is being formed. This progression of conductor pairs from position changing means and into the finished core unit will be described with reference to two pairs only. The action of these two pairs is typical of all other pairs passing through the apparatus and into the core unit.

FIG. 13 shows, as dots, the positions of all of the conductor pairs 10 at a specific time as they emerge from the position changing means 20. At that time, two of the conductor pairs 1O*a* and 1O*b* are in positions 82 and 84 respectively as shown by FIG. 13. Both conductor pairs 10*a* and 10*b* are moving towards the left hand side of FIG. 13 with conductor pair 10*a* having only just commenced movement in that direction and conductor pair 1O*b* almost at the end of its movement before returning in the opposite direction.

At some later time, and with the conductor pairs moving laterally at different speeds, conductor pair 10*a* has now reached position 84 towards the end of its movement towards the left. At this stage, conductor pair 10*b* has completed movement towards the left and is at some intermediate position 86 of movement towards the right.

The corresponding positions 80, 82, 84 and 86 for movement of the two conductor pairs across the array 72 and as they pass through the dies 74 and 76 are shown in FIGS. 14, 15 and 16.

The positions of conductor pairs in the array and as they pass through the profile dies 74 and 76 have some control over their position in the finished cable core unit. The final position of each of the pairs is, of course, also dependent upon the pressure applied to them in a lateral direction by other pairs as they approach and enter the closing die 18. Hence, not only is each pair moved progressively in one direction and then in the other around the axis of the core unit as it extends along the core unit, but also its radial position in the core unit is automatically determined. This is illustrated by the positional movement and the path followed by conductor pairs 10*a* and 10*b* as they turn around the core unit axis along an axial length of the core unit. In FIG. 17, conductor pair 1O*a* follows the path 88 around the core unit between the two positions 80 and 84 while moving radially inwards and outwards randomly through the core unit. As with all other conductor pairs, pairs 1O*a* and 1O*b* move almost completely for 360° around the core unit axis before changing direction. As positions 80 and 84 in FIGS. 13 and 14 are almost at opposite ends of one complete direction of movement, then in FIG. 17, pair 10*a* substantially completes movement in one direction and almost one complete revolution around the core unit axis.

On the other hand, conductor pair 10*b* in completing one direction of movement and then commencing to move in the opposite direction between positions 82 and 86, does in fact move to its limit position 90 in one direction as it moves along path 92 in FIG. 17 between the corresponding positions 82 and 86.

As may be seen, it is impossible for any conductor pair 10 to form a complete revolution about the cable core axis before changing direction of movement around the axis. Passage of the closed together conductors in the core unit through the binding head 18 effects wrapping of a binder tape in conventional manner around the core unit and holds it in substantially circular cross-sectional shape.

The above embodiment shows that with the use of apparatus and a method according to the invention, conductor pairs in a finished core unit may be caused to follow a path which extends around the axis of the core unit as the pairs move along the core unit and without use of a stranding machine. It follows that the core unit is provided with the degree of flexibility which is required to enable it to bend and without placing undue strain on the conductor pairs.

As can be seen from FIG. 1, after movement of the core unit through the binding head, it is reeled onto a reel 94. Because the apparatus causes the conductor pairs to move around the axis of the core unit as described, there is no reason for the reel 94 to be rotated around any axis additional to its normal rotational axis 96. Thus the reel 94 is merely rotated around its own axis by a motor 98 and for this purpose may be merely held in bearings at its ends in a fixed position machine frame. It follows therefore that it is a simple matter to remove a filled reel and to replace it with an empty reel for a further reeling operation in a short space of time. In addition to this, and as shown by the modification of FIG. 18, there may be two or more reels disposed side-by-side such as reels 94 and 100 and, upon the reel 94 being filled with core unit, then the core unit issuing from the closing die is fed onto the reel 100 without stopping operation.

In a second embodiment shown in FIG. 19, the reels are dispensed with and the core unit after passage through the binding head 18 is then passed through apparatus for completing manufacture of the cable with the core unit forming the whole cable core. The bound core unit is fed into apparatus 102 for folding a core wrap 104 around the core unit and for placing a metal shield or sheath 106 onto the core unit prior to extruding a jacket around the unit by the extrusion head 108. The apparatus for providing the core wrap, sheath and jacket are of conventional construction and do not require description.

The possibility of applying a core wrap, sheath and jacket in tandem with core unit formation also makes it possible to tandemize the above operation with the twisting of individually insulated conductors into conductor pairs when incorporated with apparatus as described in U.S. patent application Ser. No. 565,634 filed Dec. 27, 1983 (Canadian Application No. 444,295, filed Dec. 23, 1983) and entitled "Forming Cable Core Units" and in the names of J. Bouffard, A. Dumoulin and M. Seguin. As described in application Serial No. 565,634, in the second embodiment of FIG. 19, the reels of conductor pairs are replaced by a plurality of twisting machines 110, i.e. one for each conductor pair 10. These machines 110 may be of conventional construction and each have two reels of individual insulated conductor. The two conductors of each machine are twisted together as they leave the machine. The twisted pairs then pass through a tension reducing means which enables the twisting machines to be placed in tandem with the core unit forming means. The tension reducing means comprises two cylinders 112 and 114 which are rotating at a peripheral speed greater (e.g. 5% greater) than the draw speed of the conductor pairs into the closing die 78. As described in application Ser. No. 565,634, the cylinders do not drive the conductor pairs along their feedpath. Instead, the areas of contact between cylinders 112 and 114 and conductor pairs are merely sufficient to assist in drawing the pairs through the apparatus with some slippage because of the excess peripheral speed of the cylinders. The degree of grip of the conductor pairs upon the cylinders and which thus controls the amount of assistance provided by the cylinders in drawing the conductor pairs from the twisting machines, is dependent upon the degree of tension in each conductor pair downstream from the cylinders.

Hence, when there is a small tension in any pair downstream from the cylinders, the cylinders provide no assistance in drawing the pairs 10 because the grip upon the cylinders is unsubstantial. If downstream tension increases, thereby increasing this grip, the cylinders provide a degree of assistance corresponding to the degree of grip. Of course, immediately this assistance is given, the downstream tension reduces thereby reducing the degree of grip and thus of cylinder assistance. The cylinders thus reduce the tensions downstream to enable the conductor pairs to be formed, at low tension, into the core unit. The operation of the tension reducing means which enables the twisting operation to be tandemized with the core unit forming process is described in detail in application Ser. No. 565,634.

It is clear therefore that the invention provides not only a core unit having conductor pairs extending around its center to provide the normal flexibility for a core unit, but also simplifies the operation of the apparatus, i.e. it enables reels to be replaced simply and quickly or it enables the core unit to be formed in tandem with the cable finishing processes. Clearly, greater core and cable flexibility is provided if each conductor pair extends around the core unit axis for almost a complete revolution. However, it is preferred that the movement around the core axis of each pair subtends an angle of at least 180° with the core unit axis. In particular, extremely good flexibility is obtained with the angle at least 270°. In addition to this, it is also clear that each conductor pair moves through the core unit completely independently of other conductor pairs and as dictated by the use of the position changing means in addition to the array forming means. Each conductor pair in fact follows a path around the core unit through inner and outer radial positions so as to lie close to any other conductor pair for only short distances of the core unit. Thus the apparatus provides improvements in the electrical characteristics such as in mutual capacitance or lowering the coefficient of deviation of mutual capacitance between the pairs and lessening outer pair capacitance unbalance. The independent movement of the conductor pairs throughout the core unit also leads to a reduction in cost.

What is claimed is:

1. Apparatus for forming a core unit from telecommunications conductor units each formed of twisted together insulated conductors comprising, in a downstream direction along a passline for the conductor units:

a position changing means for changing the positions of laterally spaced-apart conductor units across the passline and relative to other conductor units;

conductor unit array forming means comprising at least two rollers having rotational axes one downstream from the other with opposed peripheral surfaces of the rollers spaced apart one on each side of the passline, each surface changing in diameter along its length with one surface having its smallest diameter and the other its largest diameter at a position intermediate its axial ends, the positions and configurations of the surfaces being such that together they are operable to position the conductor units in an array as the conductor units move towards, past and then beyond the rollers, the array extending in two planes in a section taken across the passline, the rollers enabling the conductor units to move across the array dependent upon the positional change caused by the position changing means; and a core unit forming means for causing convergence of the conductor units in the array to bring them together with the relative positions of the conductor units changing in the core unit as they extend along the core unit, each conductor unit extending around the axis of the core unit alternately in opposite directions as influenced by its movement across the array.

2. Apparatus according to claim 1, wherein the position changing means is continuously operable to change position of each conductor unit laterally across the feedpath.

3. Apparatus according to claim 1, wherein in side elevation, one of the rollers has a concave peripheral surface and the other has a convex peripheral surface.

4. Apparatus according to claim 3, wherein the roller with the convex peripheral surface is disposed downstream from the other roller.

5. Apparatus according to claim 3, wherein the rollers are operable together to provide a curved array of conductor units with sides of the array extending upwardly from an intermediate region of the array and the core unit forming means comprises a closing die means having an upstream die opening of greater height than width and a smaller die opening of substantially circular configuration, the smaller die opening having a center disposed below the center of the upstream die opening whereby the upstream die opening is operable to guide conductor units engaging its upper side regions into engagement with the upper regions of the smaller die opening.

6. A method for forming a core unit from telecommunications conductor units each formed of twisted together insulated conductors, the method comprising:

(a) moving a plurality of conductor units in laterally spaced relationship along a passline while:- moving the laterally spaced conductor units into an array across the passline, the array of controlled configuration extending in two planes in a section taken across the passline; and moving each conductor unit alternately in opposite directions across the passline independently of other units at a position upstream from the array so that each conductor unit moves alternately in opposite directions across the array and the conductor units move laterally relative to one another in the array; and (b) causing the conductor units in the array to converge as they continue along the passline so as to bring them together to form the core unit with the relative positions of the conductor units changing in the core unit as influenced by their relative positions in the array and with each conductor unit moving around the axis of the core unit alternately in opposite directions as it moves along the core unit as influenced by its movement across the array.

7. A method according to claim 6, comprising changing the relative positions of the conductor units in continuous manner upstream from the array whereby, in the core unit, the relative positions of the conductor units change in a continuous manner.

8. A method according to claim 7, comprising moving some at least of the conductor units so that they move across the array alternately in one direction and then in the other a sufficient distance to cause said conductor units to move alternately around the core unit in opposite directions while subtending an angle greater than 270° from the axis of the core unit for each direction of movement around the axis.

* * * * *